US007836970B2

(12) United States Patent
Bruins et al.

(10) Patent No.: US 7,836,970 B2
(45) **Date of Patent: *Nov. 23, 2010**

(54) IMPACT FASTENER TOOL WITH CAP FEED

(75) Inventors: Roger C. Bruins, Hudsonville, MI (US); Roger A. Vanden Berg, Hudsonville, MI (US); Ross Kooienga, Hundsonville, MI (US)

(73) Assignee: National Nail Corporation, Grand Rapids, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/383,775

(22) Filed: Mar. 27, 2009

(65) Prior Publication Data

US 2009/0184149 A1 Jul. 23, 2009

Related U.S. Application Data

(63) Continuation of application No. 11/818,471, filed on Jun. 14, 2007, now Pat. No. 7,530,483.

(60) Provisional application No. 60/814,182, filed on Jun. 16, 2006.

(51) Int. Cl.
*B27F 7/00* (2006.01)

(52) U.S. Cl. ..... 173/1; 227/136; 227/120

(58) Field of Classification Search ..... 227/120, 227/136, 129, 133, 135, 138; 173/1, 90, 173/91

See application file for complete search history.

(56) References Cited

U.S. PATENT DOCUMENTS

| | | | |
|---|---|---|---|
| 2,664,565 | A | 1/1954 | Percoco |
| 2,667,639 | A | 2/1954 | Schick |
| 3,319,864 | A | 5/1967 | Adams |
| 3,385,498 | A | 5/1968 | Downie |
| 3,596,820 | A | 8/1971 | Lou |
| 4,033,499 | A | 7/1977 | Butler |
| 4,182,474 | A | 1/1980 | Sato |
| 5,069,340 | A | 12/1991 | Ernst et al. |
| 5,184,752 | A | 2/1993 | Zylka et al. |
| 5,292,048 | A | 3/1994 | Vanderwiel |
| 5,339,983 | A | 8/1994 | Caple |
| 5,501,002 | A | 3/1996 | Fukami |
| 5,634,583 | A | 6/1997 | McGuinness et al. |
| 5,934,504 | A | 8/1999 | Elliott |
| 5,947,362 | A | 9/1999 | Omli |
| 5,975,401 | A | 11/1999 | Fealey |
| 6,012,623 | A | 1/2000 | Fealey |

(Continued)

*Primary Examiner*—Brian D Nash
(74) *Attorney, Agent, or Firm*—Flynn, Thiel, Boutell & Tanis, P.C.

(57) ABSTRACT

A manually swingable hammer-type stapling tool having an elongate housing having a striker movably mounted thereon. A staple driving blade is mounted on the housing and movable relative to the striker along a staple discharge path when the striker impacts against a surface. A staple magazine is carried on the housing for containing a clip of staples so that a leading staple of the clip is disposed in a staple discharge path below the driving blade. A cap supply and feeding arrangement is mounted on the housing for positioning a cap in a discharge position wherein it is disposed below the leading staple, which arrangement includes a cap magazine containing a significant number of individual caps, and inertia energy activated feeding mechanism for advancing a leading cap into the discharge position.

8 Claims, 8 Drawing Sheets

U.S. PATENT DOCUMENTS

| | | | | |
|---|---|---|---|---|
| 6,027,004 | A | 2/2000 | Ramella et al. | |
| 6,302,310 | B1 | 10/2001 | Lamb | |
| 6,478,209 | B1 | 11/2002 | Bruins et al. | |
| 6,508,392 | B1 | 1/2003 | Huang | |
| 6,543,666 | B1 | 4/2003 | Huang | |
| 6,550,660 | B1 | 4/2003 | Chlebowski et al. | |
| 6,659,326 | B2 | 12/2003 | Huang | |
| 6,779,700 | B2 | 8/2004 | Bruins et al. | |
| 6,837,412 | B2 | 1/2005 | Lamb | |
| 6,918,523 | B1 | 7/2005 | Chou | |
| 6,932,260 | B1 | 8/2005 | Chou | |
| 6,966,389 | B1 | 11/2005 | Riggs | |
| 6,968,945 | B2 | 11/2005 | Bruins | |
| 7,232,050 | B2 | 6/2007 | Omli | |
| 7,481,346 | B2 * | 1/2009 | Vanden Berg et al. | 227/147 |
| 7,530,483 | B2 * | 5/2009 | Bruins et al. | 227/120 |
| 2001/0030138 | A1 | 10/2001 | Bruins et al. | |
| 2002/0096548 | A1 | 7/2002 | Huang | |
| 2002/0121069 | A1 | 9/2002 | Smeja et al. | |
| 2003/0015565 | A1 | 1/2003 | Lee | |
| 2003/0146261 | A1 | 8/2003 | Huang | |
| 2003/0192930 | A1 | 10/2003 | Lamb | |
| 2003/0213829 | A1 | 11/2003 | Bruins et al. | |
| 2004/0079781 | A1 | 4/2004 | Huang | |
| 2006/0118592 | A1 | 6/2006 | Ho | |
| 2006/0186167 | A1 | 8/2006 | Omli | |

* cited by examiner

IMPACT FASTENER TOOL WITH CAP FEED

CROSS REFERENCE TO RELATED APPLICATION

This application is a continuation application of Ser. No. 11/818,471, filed Jun. 14, 2007, now U.S. Pat. No. 7,530,483, which claims benefit of U.S. Provisional Application No. 60/814,182, filed Jun. 16, 2006.

FIELD OF THE INVENTION

This invention relates to a hammer-type fastener tool, specifically a stapler tool, and in particular relates to improvements in the constructional and operational features of such tool which permit impact-actuated automatic advancing of a cap strip.

BACKGROUND OF THE INVENTION

Heavy duty stapling tools are widely used in the building or construction industry, with such tools being both of the power driven type, typically pneumatic driven tools, and manual type, commonly referred to as hammer-type staplers since the tool is manually swung and impacted against a surface such as a roof or wall substrate so as to effect ejection of a staple.

To permit use of staples for securing sheathing and sheeting to walls and roofs, often as a substitute for a cap nail, tools have been developed which position a plastic cap in the discharge path of a staple so that, upon operation, the staple penetrates the cap prior to penetrating the substrate so that the cap provides significantly increased gripping strength relative to the sheathing or sheet material being fastened over the substrate. Examples of power-operated staplers which employ plastic caps are illustrated by U.S. Pat. Nos. 5,184,752, 6,302,310 and 6,478,209. In the tools of these patents, the basic stapling tool is pneumatically operated and mounts thereon a storage magazine for a plurality of plastic caps, with a leading cap being supplied into the staple discharge path for penetration by the staple during tool activation. While tools of this type perform a desirable and efficient stapling operation, nevertheless such tools may be disadvantageous with respect to their cost and their need for connection to a power source, such as a source of pressurized air for operating the tool. These tools are also generally fairly large and heavy, and the associated air hose makes tools of this type difficult to use when the sheathing or sheet material is being fastened to a relatively upright surface.

In addition, with many of the known tools, such as those illustrated in the U.S. Pat. Nos. 5,184,752 and 6,302,310 mentioned above, the tool includes a rather large upright canister for containing therein a vertical stack of caps, all of which are independent of one another, whereby loading of the tool with caps may be difficult, particularly when one considers the environment within which the tools are utilized.

Because of factors such as cost and complexity as associated with power tools as mentioned above, manually operated tools, specifically hammer-type staplers, are utilized, particularly by workmen who utilize such tool for smaller jobs or on a less frequent basis. Further, hammer-type staplers are more convenient to utilize when stapling sheathing or sheet material to a vertical or generally upright surface. In recognition of situations where hammer-type staplers are desired, it has been proposed to provide such hammer-type stapler with caps so as to increase the flexibility and improve the quality of the stapling operation being carried out. In this regard, U.S. Pat. No. 6,966,389 proposes a hammer-type cap stapler wherein a cap supply cylinder is attached to the tool for maintaining therein a vertical stack of independent caps, and the caps are discharged from the bottom of the cap cylinder so that a cap is fed into the staple discharge path for penetration by the staple during each manual activation of the tool. Further, the tool of '389 has the cap supply cylinder positioned forwardly from the impact end of the tool, which may cause overweighting of the head end of the tool and may provide an undesirable balance with respect to the feel of the tool when gripped and manually operated. The positioning of the cap storage cylinder adjacent and protruding outwardly from the impact end of the tool also prevents the tool from being utilized in close association to a wall or obstruction which protrudes upwardly from adjacent the area where stapling is desired.

Assignee's U.S. Application Ser. No. 60/758,823, filed Jan. 13, 2006, now U.S. Ser. No. 11/652,333, now U.S. Pat. No. 7,481,346, discloses an improved manually-operated hammer-type cap stapler tool which utilizes a supply of caps defined by an elongate strip of individual caps which are serially joined edge-to-edge, with the leading cap of the strip being fed into a position aligned with the staple discharge. The cap stapler tool of this earlier application employs a wholly manually-actuated mechanism for advancing the lead cap into the discharge position, and hence provides a tool having a high degree of flexibility, mechanical simplicity and economy. Since the tool requires a deliberate manual activating of the cap feeding mechanism, however, such may be considered less effective in job situations where a large volume of impact fastening operations is to be carried out in rapid succession.

Accordingly, it is an object of this invention to provide an improved cap fastener tool, specifically a manually-operated hammer-type cap stapling tool which is manually swung and impacted against a surface to cause a stapling operation, which improved cap stapling tool provides improved constructional and operational features which are believed to overcome many of the disadvantages discussed above.

More specifically, this invention relates to an improved manually-swingable hammer-type cap fastener tool and preferably a cap stapler tool which, in a preferred embodiment, utilizes a cap supply defined by an elongated row of individual caps which are serially joined edge-to-edge, with the lead cap as positioned in the fastener (i.e., staple) discharge path being separated from the serial cap strip during the fastener (i.e., staple) discharge operation, with the cap strip being automatically advanced by an inertia-activated feeding mechanism to move the next lead cap into the discharge position as a result of the preceding impact and staple discharge.

A further object of the invention is to provide an improved hammer-type tool, as aforesaid, wherein automatic advancing of the cap strip following each impact-discharge operation enables the tool to be easily and rapidly operated in a sequential manner without requiring any additional operation or manipulation by the operator, other than the sequential swinging and impacting of the tool against the substrate.

A still further object of the invention is to provide an improved hammer-type tool, as aforesaid, wherein the tool employs a feeding mechanism for advancing the lead cap into the discharge position, which feeding mechanism is activated by inertia energy associated with an activating mass which is mounted on the tool and is moveably displaced by impact of the head end of the tool against a substrate and the consequent discharge of the staple through the lead cap into the substrate, with the consequent inertia-caused movement of the mass relative to the tool being utilized to retract a cap feeding member against the urging of a spring so that the cap feeding member engages the next leading cap of the strip, with the spring thereafter advancing the feeding member and the next leading cap into the discharge position during the rebound movement of the tool away from the substrate. The advancing of the cap member by the spring also automatically resets the activating mass into its original position so as to permit inertia displacement thereof during the next succeeding impact operation. The entire movement of the cap feeding mechanism, including the inertia-caused movement of the mass and the corresponding retraction of the cap feeder, and the subsequent advancing of the cap feeder and cap and the return movement of the activating mass, all occur rapidly and sequentially during rebound of the tool immediately following the impact, thereby enabling the tool to quickly return to a reset position to permit the next impact stapling operation to be carried out. At the same time, however, the cap feeding member does not influence or detract from the manual impact force which must be applied to the tool to permit efficient carrying out of the impact stapling operation.

Still another object of the invention is to provide an improved hammer-type tool, as aforesaid, wherein the cap strip is formed into a spirally-wound spool which is disposed in a cap storage chamber mounted directly on the housing of the tool adjacent one side thereof, and generally between the front and rear ends of the tool, thereby minimizing the overall length of the tool. In addition, the activating mass for activating the cap feeder, and the cap storage canister, are preferably disposed adjacent opposite sides of the tool to provide the tool with desirable side-to-side balance. The actuating mass is also preferably provided in close proximity to the head end of the tool so as to provide maximum efficiency with respect to generation of inertial energy, and the providing of the activating mass and the cap canister in the vicinity of the head end of the tool provides the head end with additional counter-weight effect, and hence permit the stapler tool to be constructed with lesser counter-weight mass than is typically required.

A further object of the invention is to provide an improved hammer-type tool, as aforesaid, wherein the serially joined caps are wound spirally into a roll or coil which can be positioned in a storage magazine mounted on the tool, thereby improving loading and storing of caps on the tool.

Another object of the invention is to provide an improved hammer-type tool, as aforesaid, with a cutting mechanism, similar to a scissor-type cutting structure, which effectively cuts the web or connecting strip which joins serially adjacent caps, with the cutting mechanism effecting cutting of the web so as to sever the lead cap from the remaining cap strip during the staple ejecting operation, thereby providing an improved staple/cap discharge operation which minimizes potential disturbance to the cap strip remaining in the tool.

Other objects and purposes of the improved hammer-type cap stapling tool of the present invention will be apparent to persons familiar with stapling tools upon reading the following specification and inspecting the accompanying drawings.

SUMMARY OF THE INVENTION

This invention relates to a manually-operated hammer-type cap stapling tool which employs an elongate hammer-type stapling unit defined by an elongate housing having a staple magazine positioned lengthwise thereof and having a discharge path at the impact or head end of the housing which, upon impact of a striker as provided at the head end against a surface, causes a driving element on the housing to transversely discharge a staple disposed at a lead end of the staple magazine. The tool has a manually-engagable grip part defined adjacent the other end of the housing. In a preferred embodiment, a cap storage magazine is fixed to the housing and contains an elongate strip of caps which are peripherally joined edge-to-edge. The leading end of the cap strip is fed along the tool so that the leading cap can be positioned to intersect the staple discharge path at the impact end of the tool. The tool preferably employs an inertia-activated feeding mechanism which automatically advances the lead cap of the cap strip, one cap spacing at a time, into the discharge position, with the cap advance being responsive to, and occurring after, impact actuation of the stapling unit. A cutting assembly having opposed relatively movable cutting edges is activated when the tool is impacted against a surface to cut a connecting strip between the leading cap positioned in the staple discharge path, and the next adjacent cap, to facilitate discharge of the staple and penetration thereof through the cap prior to its penetration into the impacted surface, and prior to the next cap being automatically advanced into the discharge path.

Figure 1:
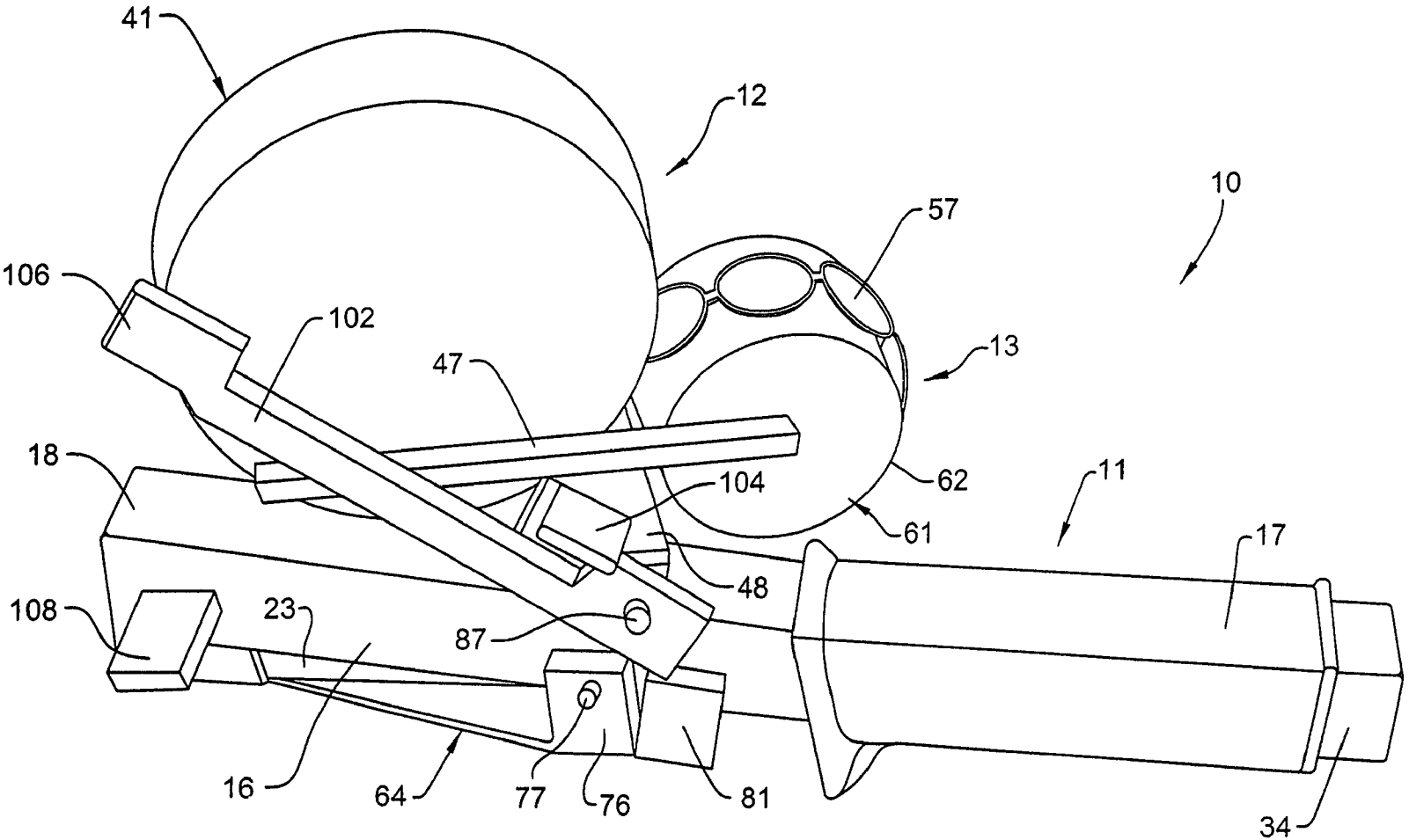
FIG. 1 is a perspective view of an improved hammer-type cap stapling tool according to a preferred embodiment of the present invention.
Figure 2:
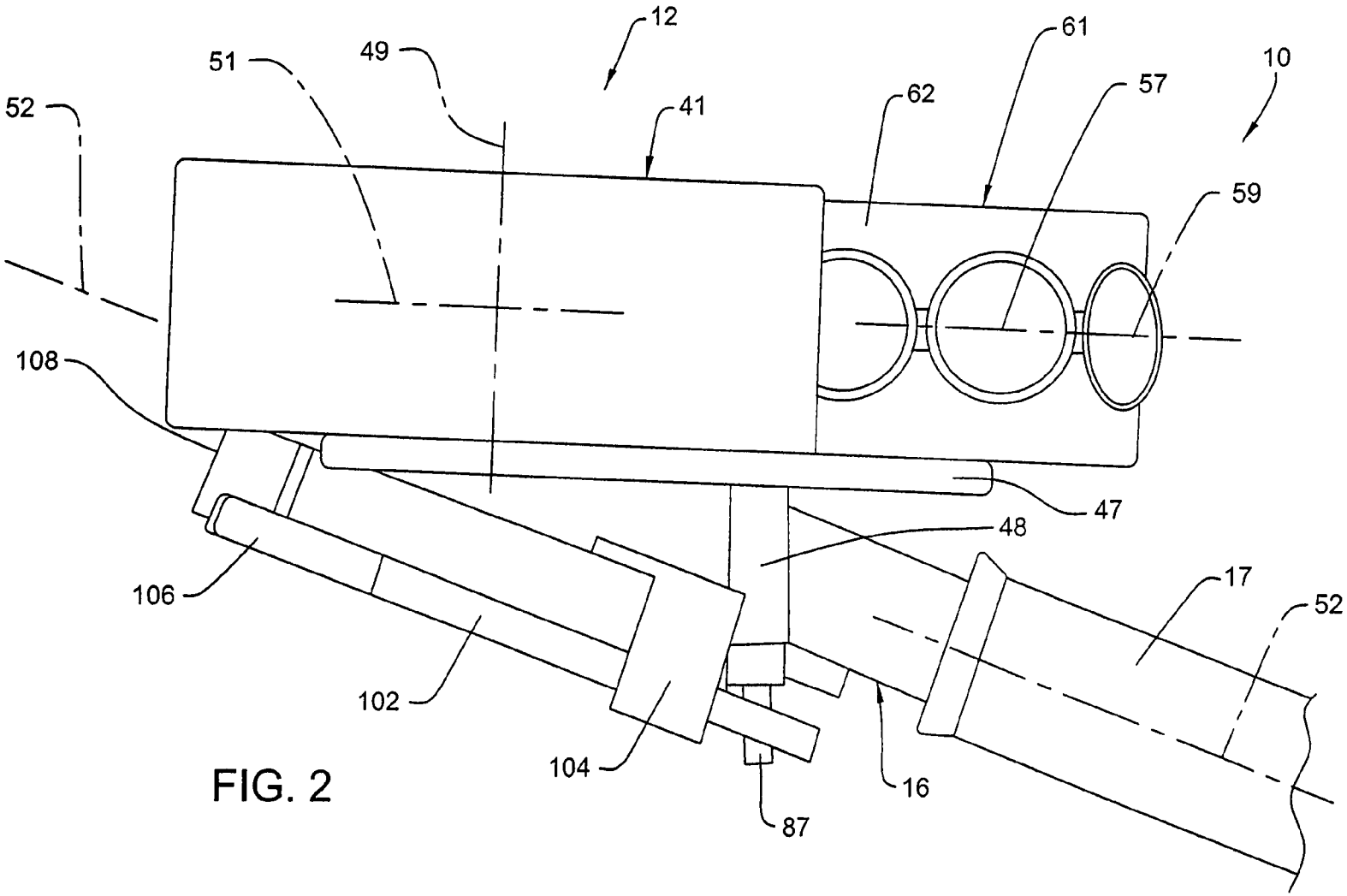
FIG. 2 is a top view of the tool illustrated in FIG. 1.

Certain terminology will be used in the following description for convenience in reference only, and will not be limiting. For example, the words "upwardly", "downwardly", "rightwardly" and "leftwardly" will refer to directions in the drawings to which reference is made. The words "right" and "left" will also refer to those sides of the tool which are visibly observed by a user when the tool is manually gripped and held in a position of use. The word "forward" will refer to the normal direction of feeding movement of the caps and staples toward the discharge position, which movement in the illustrated tool is in a direction from the hand grip toward the head or impact end of the tool. The words "inwardly" and "outwardly" will refer to directions toward and away from, respectively, the geometric center of the tool and designated parts thereof. Said terminology will include the words specifically mentioned, derivatives thereof and words of similar import.

DETAILED DESCRIPTION

Referring to FIGS. 1-7, there is illustrated a preferred embodiment of a manually-operated hammer-type cap fastener tool 10 according to the present invention. This tool 10, in the disclosed and preferred embodiment, uses staples as fasteners, and is defined principally by a stapler unit 11 having a cap supply 12 mounted adjacent the head end of the tool, a guide arrangement 13 for feeding individual caps into a discharge position adjacent the head or impact end of the tool, and a feeding arrangement 14 which effects controlled feeding of caps toward the discharge position.

The stapler unit 11, considered by itself, is generally conventional and well known, but will be described herein both for background purposes and for facilitating description of its structural and functional cooperation with the cap supply, feeding and discharge features associated with the present invention.

Figure 8:
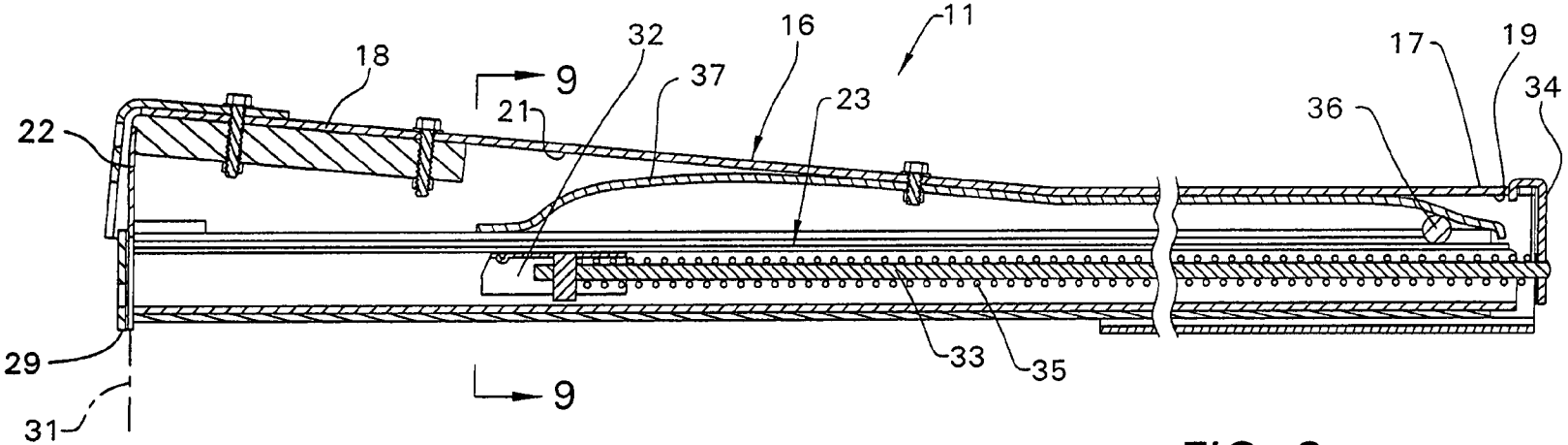
FIG. 8 is a sectional view of solely the stapler tool as taken generally along a lengthwise or longitudinally extending central upright plane to illustrate the conventional construction of the cap storage and feeding structure.
Figure 9:
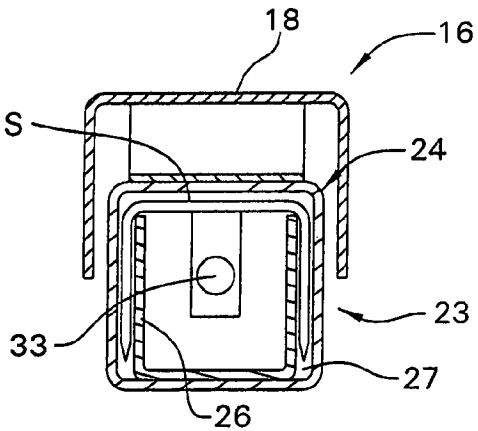
FIG. 9 is an enlarged cross-sectional view taken generally along line 9-9 in FIG. 8.

More specifically, the stapler unit 11 (FIGS. 8 and 9) includes an elongate rigid housing 16 having a grip part 17 defined adjacent one end thereof, and a head part 18 which effectively defines the other end of the housing. The grip part 17 is traditionally of a hollow tubular cross section defining an opening 19 therethrough, and the head part 18 typically has a channel-shaped cross section so as to define therein a downwardly-opening interior channel 21, the latter communicating with the opening 19 which extends through the grip part 17. The housing 16, in close proximity to the free end of the head part 18, mounts therein a conventional staple driving member or blade 22 which cooperates for discharging a staple in a conventional manner, as discussed hereinafter.

The stapler unit 11 also includes an elongate staple magazine 23 which extends generally lengthwise of the housing 16 and is disposed so as to be at least partially nested or positioned within the housing 16 substantially throughout the length thereof. This staple magazine 23 includes an elongate generally hollow housing 24 which mounts therein an inverted U-shaped guide track 26, the latter cooperating with the inner wall of the housing 24 to define a generally channel-shaped guide groove 27 extending lengthwise of the housing 24. The guide groove 27 in a conventional manner accommodates therein a conventional staple clip, that is, an elongate row of U-shaped staples S positioned in adjacent side-by-side abutting relation. The staple clip is slidably supported on the interior guide track 26 and is urged forwardly toward the head end of the stapler unit so that the leading or endmost staple of the clip is positioned in alignment with a transverse discharge opening 28 associated with the head or impact end 29 (often referred to as the striker) of the magazine housing 24. The discharge opening 28 extends transversely through upper and lower walls of the staple magazine housing 24 so that the staple driving blade 22 as mounted on the main housing 16 is aligned with this opening, and hence is transversely aligned with the endmost staple of the clip to permit discharge of the endmost staple through the opening 28 along a discharge path 31 which extends generally transverse to the lengthwise extent of the stapler housing.

The bottom wall of the striker 29, adjacent to the discharge opening 28, conventionally acts as the impact or striker surface inasmuch as this is the area or wall which typically impacts a surface during discharge of a staple into the surface.

The elongate staple clip positioned in the staple magazine housing 24 is normally urged forwardly by a channel-shaped pusher 32 which is slidably supported on the guide track 26 for engagement with a rear end of the staple clip. This pusher 32 is slidably supported on an elongate guide rod 33 which extends lengthwise of the housing 24 and has its rearward end fixed to a removable or openable rear cover 34 which closes off the grip end of the housing 16. A conventional coil spring 35 surrounds the guide rod 33 and cooperates between the rear cover 34 and the pusher 32 to normally urge the staple clip forwardly so that the front endmost or lead staple abuts against a suitable stop and is maintained in transverse alignment with the discharge opening 28 for contact and discharge by the staple driving blade 22 during activation of the tool.

The staple magazine 23 has the rear end portion thereof disposed to project into the interior of the hand grip 17, and the main housing 16 and staple magazine housing 24 are coupled by a pivot 36 which extends transversely between the side walls of the housing grip part, thereby enabling the staple magazine 23 to be vertically swingably displaced relative to the housing 16 about the axis of the pivot 36. To accommodate such pivoting, the forward end of the staple magazine 23 is capable of nesting within the channel-shaped housing head part 18, but normally protrudes downwardly therefrom, being urged into this downwardly protruding position by a spring 37, such as a leaf spring, which cooperates between the top wall of the magazine housing 24 and the top wall of the main housing 16. Spring 37 normally maintains the staple magazine in its angled extended position wherein the head or free end of the staple magazine angles away and hence protrudes outwardly of the housing head part 18, with the staple magazine being maintained in this "normal" position due to the magazine housing 24 abutting a stop, such as the lower wall of the tubular housing grip part 17.

The construction and operation of the stapler unit 11 as described above, and as illustrated in the accompanying drawings, is conventional. One example of a hammer-type stapler tool possessing these features is manufactured and sold under the Prebena brand name, Model No. HHPF09.

Considering now the cap supply 12 as associated with the tool 10 of this invention, this cap supply 12 includes a cap chamber or magazine 41 which, in the illustrated embodiment, is mounted on the housing 16 in close proximity to the head part 18 thereof. The cap chamber 41 defines therein an interior compartment 42 which, in the illustrated embodiment, is generally cylindrical for storing therein a cap spool as described hereinafter. The cap chamber 41 is defined by a generally outer peripheral wall 43 which approximates a cylinder and which is oriented so that the axis 49 thereof extends transversely with respect to the elongate direction of the housing 16 and hence transversely with respect to the plane of swinging movement of the staple magazine 23. The outer peripheral wall 43 of the cap chamber 41 has an axial dimension which typically does not significantly exceed the width of the tool housing, as controlled by the diameter of the caps associated with the cap spool, and opposite sides or ends of the cap compartment 42 are at least partially closed by end walls 44 and 46.

The cap chamber 41 is preferably constructed so as to be readily opened to permit loading of a cap spool therein. For this purpose, the opening feature may be permitted by constructing the end wall 46 as an openable or removable end wall, such as by providing the end wall 46 as a wholly separate member which has a releasable flange for engagement with the peripheral wall 43, or by providing the end wall 46 with a hinged connection to the peripheral wall 43 to permit swinging of the end wall into an open position. Another alternative is to construct the cap chamber 41 of a clamshell-like construction defined by upper and lower arcuate parts which are joined by a generally transverse horizontal hinge so that the upper clamshell part can be swingably moved between open and closed positions. Numerous variations of the construction of the cap chamber 41 can be provided so as to permit access to the interior thereof for loading of a cap spool therein.

In the illustrated arrangement, the cap chamber 41 is stationarily mounted on the tool housing 16 by means of a generally L-shaped support which includes an elongate support arm 47 which is rigidly joined to the end wall 44. The support arm 47 in turn is rigidly joined to a support block 48 which extends transversely across and is rigidly joined to the upper wall of the tool housing 16 at a location intermediate the opposite ends thereof. The L-shaped support defined by the arm 47 and block 48 result in the cap chamber 41 being disposed slightly above and slightly sidewardly offset relative to the head part 18 of the tool housing 16, with the cylindrical interior chamber of the cap magazine 41 having its axis 49 disposed upwardly above the housing 16 and oriented transversely in non-perpendicular relationship to the lengthwise extending direction 52 of the tool housing 16. That is, this axis 49, when viewed in plan view (FIG. 2), is slightly forwardly angled relative to the perpendicular transverse direction of the tool. This results in the center upright plane 51 of the cap magazine 41 hence being disposed in angled relationship relative to the lengthwise extending axis 52 of the tool. This plane 51 of the cap magazine and the lengthwise tool axis 52 preferably intersecting at or in close proximity to the transverse staple discharge opening 28.

The cap chamber or magazine 41 is adapted to mount a cap roll 56 therein, which roll is also referred to as a cap coil or spool. The cap roll 56 is defined by an elongate row or strip of individual disc-shaped caps 57 positioned in adjacent edge-to-edge relationship, with the adjacent caps 57 being suitably interconnected, such as by small webs 58 which join between the peripheral edges of the adjacent caps 57, thereby defining an elongate strip of interconnected caps. The caps and webs are typically and preferably formed of a plastics material, such as by molding or extruding, in a plastics forming operation which enables an elongate strip of caps to be formed, with the elongate strip of joined caps then being spirally wound to define the roll 56.

The individual caps 57 are typically molded of a plastics material and typically have a slightly domed configuration in cross-section, with the underside of the cap defining a shallow concave recess, and the upper surface of the cap having a shallow convex configuration. Such configuration permits limited resilient flexing of the middle of the cap when a staple or nail is driven therethrough, thereby providing increased gripping engagement between the periphery of the cap and the flat surface with which it is engaged. The disc-shaped plastic caps 57 are typically about one-inch in diameter. The construction of the caps 57, as well as the forming of the caps into an elongate strip wherein the adjacent caps are joined together by connecting elements such as molded plastic webs 58, and the subsequent forming of the strip into a generally spiral coil 56, is known.

The leading end of the cap strip defined by the cap roll 56 as disposed in the cap magazine 41 is supplied through the guide arrangement 13 which extends generally in the lengthwise direction along the tool 10 so as to position the lead or endmost cap 57L of the cap strip in a discharge position 55 which is located directly below the staple discharge opening 28. For this purpose, the cap guide arrangement 13 includes a rear guide track 61 which is located rearwardly of the cap magazine 41 for effecting a reversing in the movement direction of the cap strip, and which in turn feeds the cap strip to a front guide track 64 which is associated with the housing head part 18 and extends lengthwise along the underside thereof to a location adjacent the discharge position 55.

The rear guide track 61 is fixedly mounted on the housing 16 at a location intermediate the ends thereof, with the rear guide track 61 being fixed to the support arm 47 so that the guide track 61 is positioned adjacent but rearwardly of the cap magazine 41. The rear track 61 defines thereon an outer guide path member 62 which, in the illustrated arrangement, is generally cylindrical, although it will be appreciated that this outer guide path member 62 can be formed to be approximately or slightly greater than semi-cylindrical so that the upper portion thereof provides guiding communication with a guide opening 63 formed in the peripheral wall of the cap magazine 41 for permitting discharge of the cap strip from the cap magazine, with the lower peripheral portion of the guide path member 62 permitting the cap strip to be fed downwardly and forwardly to the front guide track 64. The feeding of the cap strip from the cap magazine 41 exteriorly around the guide path member 62 to the front guide track 64 is illustrated by the dash-dot path 59 in FIG. 3. This guide path member 62, like the cap magazine 41, is also sidewardly angularly offset relative to the lengthwise direction of the tool housing 16 so that the guide path member 62 has the central upright plane thereof oriented generally co-planar with the center upright plane 51 of the cap magazine 41.

The front guide track 64 is defined primarily by an elongate platelike lower guide member 66 defining thereon an upper planar guide surface 67, with a plate-like upper guide member 68 being disposed in upwardly spaced relationship to the guide surface 67 so as to define a cap passageway 73 therebetween. The passageway 73 has a height which is only slightly greater than the height of the plastic caps 57 so as to enable the cap strip to slidably move therebetween. The upper guide member 68, which effectively functions as a hold-down for the caps within the passageway 73, in the illustrated embodiment is fixed relative to the lower guide member 66 by fasteners or screws 69 joined therebetween, with spacers such as washers 71 being sandwiched between the upper and lower guide members to define the height of the passageway 73. An edge wall or rib 74 also projects along the outer lengthwise-extending edge of the lower guide member 66 so as to close off the outer side edge of the cap passage 73. The rearward end of the upper guide member 68 is provided with a rearwardly projecting end part 72 which is upwardly curved as it is cantilevered rearwardly to assist in guiding the cap strip 59 into the upstream end of the passageway 73. The passageway 73 projects lengthwise along axis 51 in slightly angled relationship along the head end 18 of the tool, with the discharge end of the cap passageway 73 terminating approximately at the discharge position 55 as diagrammatically illustrated in FIG. 5. The angle of the passageway 73 as defined by centerline 51, relative to the staple feed direction in the tool lengthwise direction as defined by axis 52, is normally in the range of about 15° to about 30°, preferably about 20°.

The front guide track 64 is supported under the head part 18 of the tool housing 16 by a pair of side plates 76 which project upwardly from the rearward end of the guide track so as to sidewardly straddle the housing 16. Aligned pivots 77 connect the side plates 76 to the side walls of the housing 16, thereby enabling the front guide track 64 to vertically pivot relative to the housing 16 about a transverse pivot axis 78 defined by the pivots 77.

Figure 3:
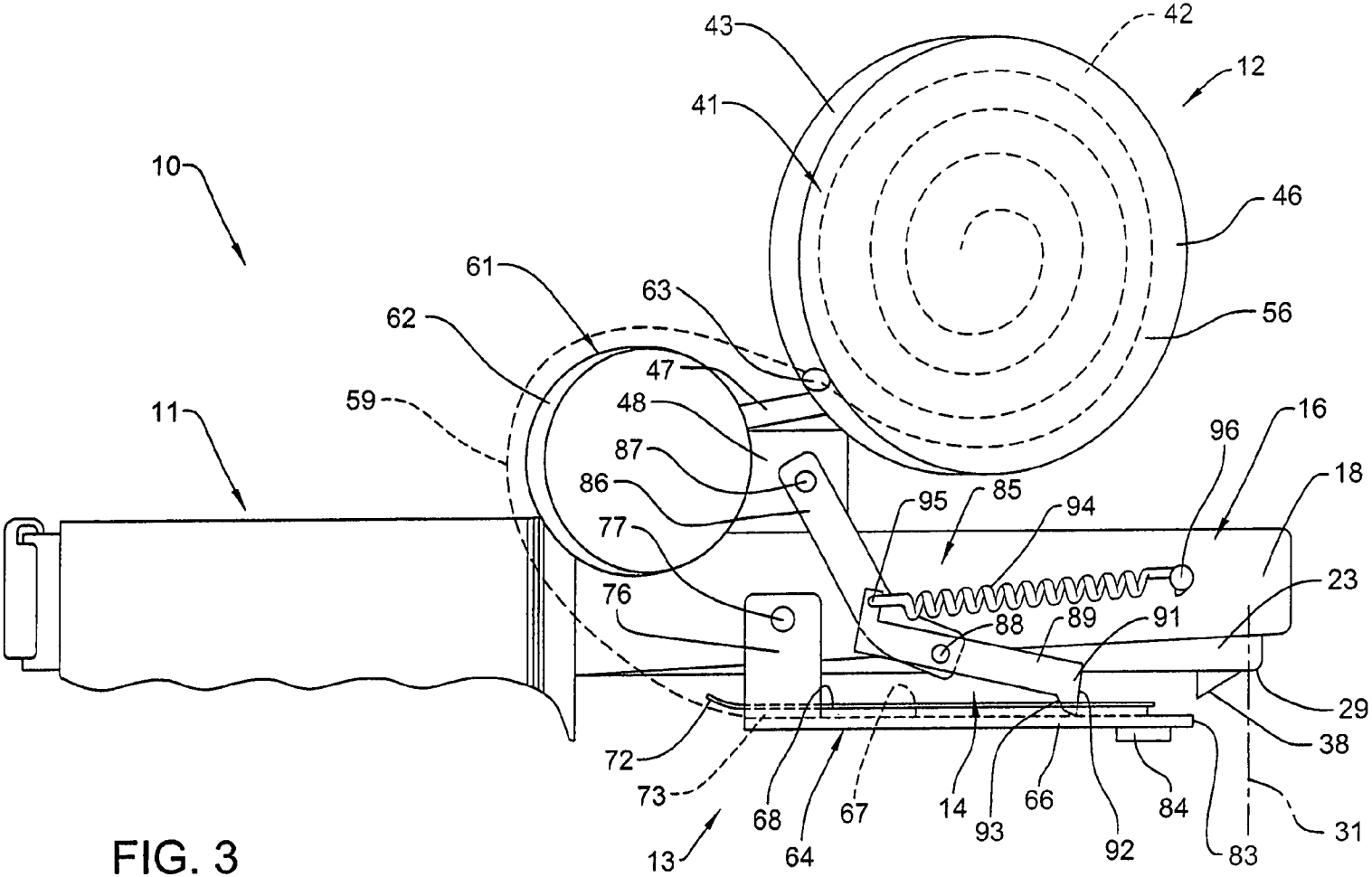
FIGS. 3 and 4 are respectively right and left side elevational views of the tool shown in FIGS. 1 and 2.

The front guide track 64 is normally maintained in a lowered or open position wherein it is swung downwardly about the pivot axis 78, substantially as illustrated in FIG. 3. A small compression-type coil spring 79 cooperates between the bottom guide plate 66 and the underside of the staple magazine 23 to normally urge the lower guide track 64 into the lower position which results in engagement of the front guide track with a stop 81 fixed to the housing 16.

The lower guide member 66 is provided with a tip end 82 which is located remote from the pivot axis 78 and is disposed generally directly under the staple magazine 23. This tip end 82 terminates adjacent the discharge station 55. Tip end 82 is formed with a cutting edge or blade 83 extending generally perpendicular to the feeding direction of the cap strip, which feeding direction is defined by the center upright plane 51. The cutting edge 83 is designed to cooperate with, and in fact pass closely upwardly adjacent, an opposed and parallel cutting edge 39 which is formed on a cutting member 38 which is fixed to and protrudes downwardly from the undersurface of the striker 29 just rearwardly of the staple discharge opening 28. When the front guide track 64 is swung upwardly toward the staple magazine 23, the cutting blades 39 and 83 relatively pass closely adjacent one another and hence effect severing of the plastic web 58 which joins the lead cap 57L, as disposed in the discharge station 55, from the next adjacent cap 57L' as associated with the cap strip contained in the passageway 73.

Since the tip end of the front guide track 64 impacts the substrate surface during operation of the tool, the underside of the tip end can be provided with a small cushion or impact pad 84 attached thereto if desired. Such pad 84 can be of a suitable rubber-like material having at least some limited cushioning or resiliency characteristic so as to improve the structural impact characteristics of the front guide track.

To control feeding and advancing of the cap strip forwardly along the guide arrangement 13 so as to advance the leading cap 57L of the strip into the discharge position 55, the tool 10 is provided with the cap feeding arrangement 14 which, in this invention, is wholly automatically activated in response to impacting of the head end of the tool against a surface. This feeding and advancing arrangement 14 relies on inertial energy created as a result of a prior impact discharge operation, and automatically effects both retracting and advancing of the feeding mechanism as a result of and immediately following an impact of the tool against a surface, as explained hereinafter.

More specifically, the cap feeding and advancing arrangement 14, as illustrated in FIG. 3, includes a cap feed linkage 85 which is positioned adjacent one side of the housing head part 18 for cooperation with the cap strip supported in the passage 73 defined by the front guide track 64. The cap feed linkage 85 includes an elongate driving lever 86 which is fixedly secured at its upper end to a rocker shaft 87, the latter being rotatably supported within the support block 48 and projecting transversely across the top of the tool housing 16. The driving lever 86 projects downwardly adjacent one side of the tool housing, and adjacent a lower end thereof, is provided with a pivot 88 which couples to a cap feeding pawl 89. The cap feeding pawl 89, in the illustrated embodiment, is formed similar to an elongate lever in that the pivot 88 is disposed intermediate the length thereof, and the cap pawl 89 protrudes forwardly away from the pivot 89 and has a drive lug 91 formed adjacent the forward free end thereof. The drive lug 91 protrudes downwardly into the cap-advancing passageway 73 adjacent the edge wall 74, whereby the downwardly protruding drive lug 91 can enter into the generally triangularly-shaped clearance space defined between an adjacent pair of connected caps 57. The drive lug 91 has a generally flat front face 92 so that, when the drive lug projects into the clearance space between adjacent caps, the flat front face 92 can engage the edge of the cap and effect pushing of the cap strip forwardly along the passage 73 during forward advancing of the cap feeding pawl 89. Conversely, the rear face 93 of the drive lug 91 has a generally rounded convex configuration so that, during rearward retraction of the cap feeding pawl 89, the drive lug 91 cams upwardly and passes over the cap without effecting rearward displacement thereof. To allow the cap driving pawl 89 to function in this manner, a spring 94 (a tension spring in the illustrated embodiment) has one end anchored to a tab 95 provided at the rearward end of the feeding pawl 89, and the other end connected to an anchor 96 fixed to the tool housing 16 adjacent the forward end thereof. Spring 94 hence always exerts a biasing force which urges the feeding pawl 89 to rotate in a clockwise direction about the pivot 88, thereby continually urging the drive lug 91 downwardly toward a position of sliding engagement with the upper guide surface 67 defined on the lower guide plate 66.

The spring 94, acting through the feeding pawl 89 and the pivot 88, also always exerts a biasing force on the driving lever 86 which tends to urge the lever 86 to swing forwardly about the pivot 87 (counter-clockwise in FIG. 3) in a cap feeding or advancing direction, with the forward urging of the lever 86 by the spring 94 being applied to the rocker shaft 87, which shaft adjacent its other end (i.e. adjacent the other side of the tool housing 16) is coupled to an inertial energy actuator 101 (FIG. 4) which is movably supported on the tool housing 16 adjacent the other side of the head part 18.

Figure 4:
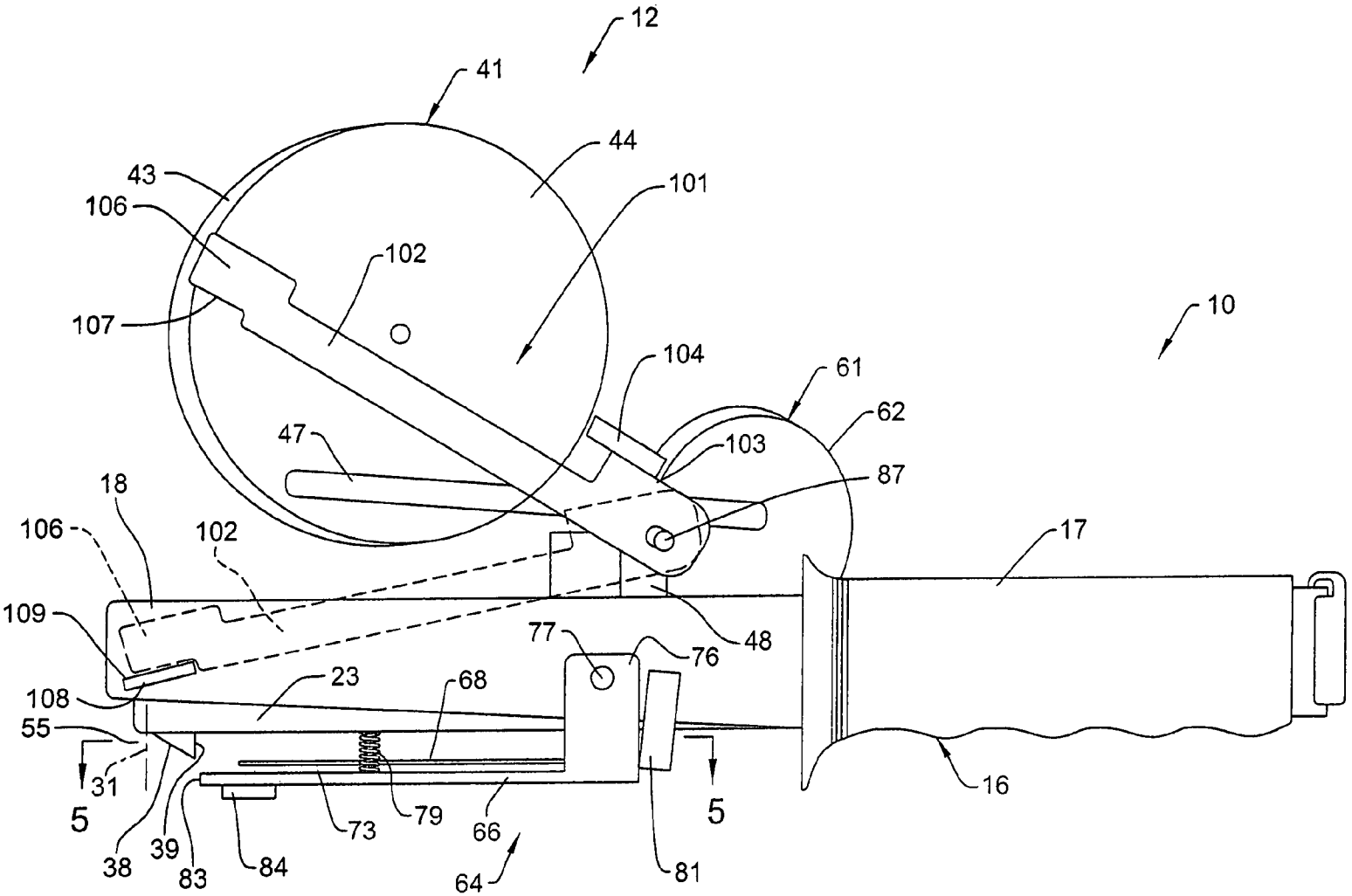

The inertial energy actuator 101 includes an elongate lever 102 which at a rearward end is fixedly (i.e. non-rotatably) coupled to the other end of the rocker shaft 87. The lever 102 is preferably fixed to the end of the rocker shaft 87 in such a manner that the elongate direction of the lever 102 does not protrude perpendicular to the rocker shaft axis, but rather is angled so that the elongate direction of the lever 102 is generally parallel but sidewardly displaced from the lengthwise axis 52 of the housing 16. The lever arm 102 hence is swingably moveable adjacent one side of the housing 16, and swings parallel to the pivoting of the staple magazine 23. The lever 102, in close proximity to the rocker shaft 87, has a stop part 103 provided thereon and positioned for engagement with a stop 104, the latter being fixed to the support block 48. Due to the biasing force imposed by the stretched tension spring 94 as described above, and as transmitted through the driving lever 86 to the rocker shaft 87, the lever 102 is normally maintained in a forwardly projecting but raised rest position substantially as illustrated by FIG. 4, in which position the stop part 103 abuts the fixed stop 104, thereby maintaining the feeding and advancing linkage 85 in the forward or advanced position illustrated in FIG. 3.

The inertia actuator lever 102, adjacent the forward free end thereof, is provided with an enlarged mass 106 which is a fixed part of the lever 102. This mass 106, when the lever 102 is in its raised cap-advanced position illustrated by FIG. 4, is disposed generally at but spaced vertically upwardly above the staple-discharge end of the tool, namely vertically spaced above the staple discharge passage 28. The mass 106 has a lower or bottom surface 107 which acts as an impact surface, and which is adapted to impact against an upper surface 109 of a stop 108 which is fixed to and protrudes sidewardly from the side wall of the housing 16 directly adjacent the impact or free end of the tool. This impact stop 108, which in the illustrated embodiment is constructed generally as a flat plate which is fixedly joined, such as welded, to the side wall of the housing so as to protrude outwardly therefrom, is positioned so that, in the lengthwise direction of the tool, it is directly sidewardly adjacent the staple discharge passage 28 and hence is substantially closely adjacent the discharge position 58 assumed by the lead cap 57L. The disposition of the impact stop 108, however, is preferably disposed at an elevation below the rocker shaft 87, so that the swinging movement of the arm 102 carrying the mass 106 thereon hence causes the arm 102 to swing downwardly from the raised position illustrated in solid lines in FIG. 4, to the lowered impact position indicated by dotted lines in FIG. 4. In this lowered position the arm 102 still projects forwardly from the rocker shaft 87 toward the impact end of the tool, but is angled downwardly. The angular displacement of the mass-carrying arm 102 between the extreme positions limited by the stops 104 and 108 is preferably restricted to an angular extent of about 45 degrees, with the end positions defined by the stops 104 and 108 preferably limiting the swinging movement of the mass-carrying arm 102 to an angle in the neighborhood of about 20 degrees angled upwardly above the lengthwise direction of the head end of the tool, and an angle of about 20 degrees angled downwardly relative to the lengthwise direction of the head end of the tool. This angular relationship results in the mass 106 when it is swingably displaced from the raised rest position to the lowered impact position as illustrated in FIG. 4, moving in a direction which is dominantly oriented parallel with the discharge direction of the staple, whereby the impact of the head end of the tool against the surface and the sudden stoppage of the high velocity swinging movement of the tool, and the structural unrestraint of the mass-carrying lever 102 in the downward swinging direction, causes the mass 106 to rapidly swing downwardly due to the inertia of its motion prior to tool impact against the surface. The inertia hence causes the mass 106 to continue swinging downwardly, after the head end of the tool strikes the surface, so that the mass rapidly swings downwardly until impacting against the stop 108. This rapid downward swinging of the mass-carrying arm 102, acting through the rocker shaft 87, causes the lever 86 to swing rearwardly (counter-clockwise in FIG. 3) against the urging of spring 94, causing the pawl driving member 89 to be retracted rearwardly (leftwardly in FIG. 3) by a distance corresponding to the center-to-center spacing between adjacent serially-joined plastic caps 57. During this retraction of the pawl member 89, the drive lug 91 cams upwardly against the urging of spring 94 so as to pass over the cap. When the mass 106 contacts the stop 108, the cap driving member 89 has been retracted a distance corresponding to the size of one cap, whereupon the spring 94 again urges the drive lug 91 downwardly to engage in the triangular clearance space between the adjacent pair of caps. At the same time, and assuming that the tool 10 has now either rebounded or been manually moved away from and hence effectively separated from the previously discharged staple/cap combination, the spring 94 automatically again urges the driving lever 86 forwardly so as to advance the cap pawl member 89 forwardly to thus drivingly push the next leading cap of the cap strip into the discharge position 55, and this also simultaneously, due to the rotation of the shaft 87, causes the mass-carrying lever 102 to be swingably returned into its raised position until contacting the stop 104, thereby maintaining the feeding and advancing mechanism, and its associated inertial energy actuator, in the cap-advanced positions illustrated by FIGS. 3 and 4.

With the cap feeding and advancing arrangement 14 of this invention, the cap feeding cycle, which is defined first by retraction of the cap feeding pawl 89 caused by the inertia-induced movement of the mass 106, followed by advancing of the cap by the spring-urged advancing of the cap feeding pawl 89 simultaneous with the spring-urged return of the mass 106 to its rest position, all occur automatically as a result of an impact of the head end of the tool against a surface so as to effect discharge of a staple through the lead cap located at the discharge position. This entire retracting and advancing cycle of the cap feeding arrangement 14 occurs rapidly after the impact, such as during rebound or withdrawal of the tool away from the surface since the impact cuts the web and hence separates the stapled cap from the remaining cap strip, whereupon the next leading cap at the free end of the strip is hence automatically and rapidly advanced into the discharge position. The tool is hence in a condition to permit a subsequent impact staple/cap discharge operation to be carried out, whereby sequential and rapid discharging of staple/cap combinations can be accomplished without requiring any special or separate manual manipulations or control functions by the tool operator.

Figure 5:
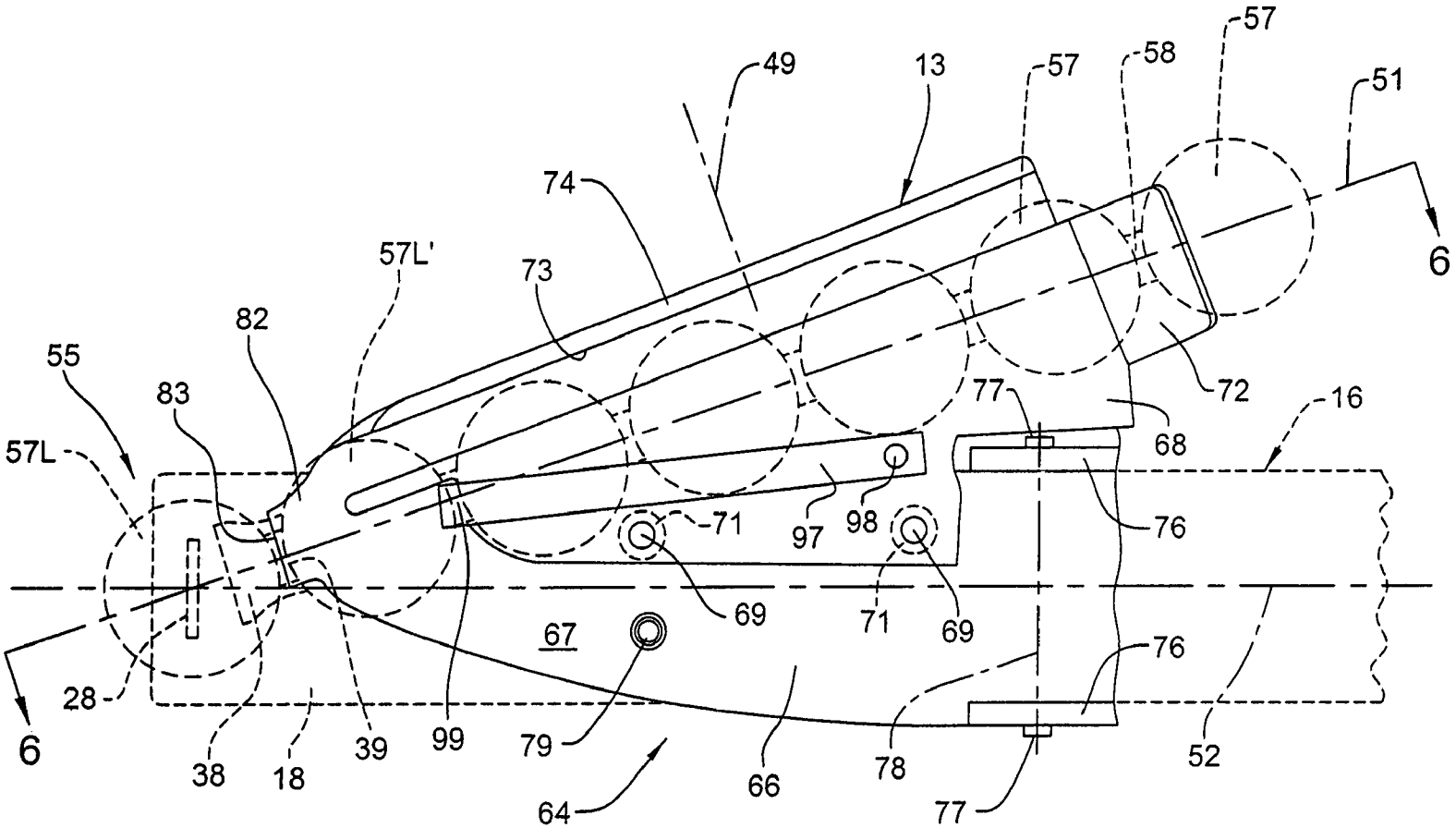
FIG. 5 is a plan view of the front guide track as taken generally along line 5-5 in FIG. 4, and showing the head end of the tool in dotted lines to illustrate the relationship of the front guide track thereto.
Figure 6:
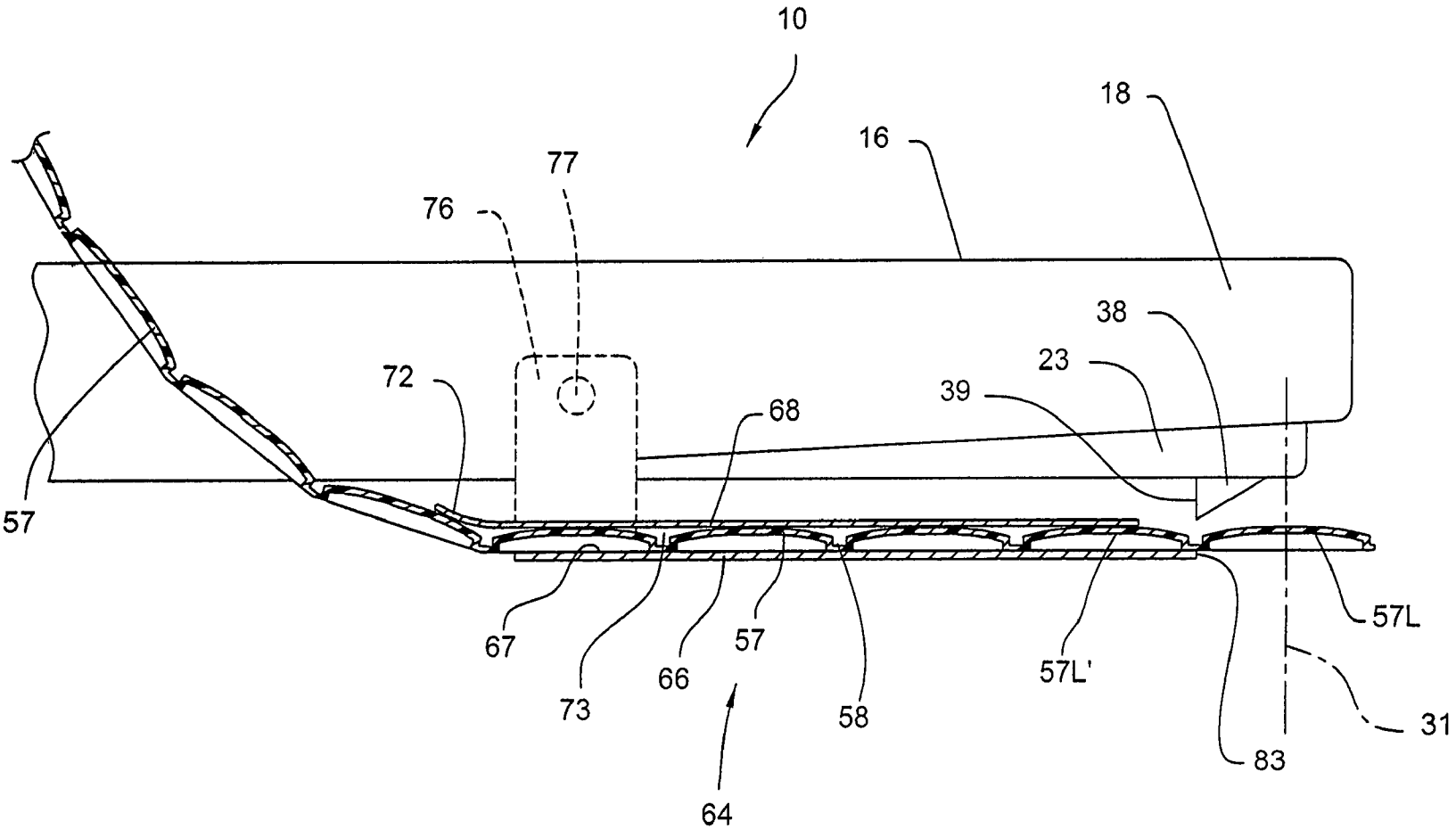
FIG. 6 is a fragmentary side view showing the head end of the tool in condition for initiating an impact staple discharge operation.
Figure 7:
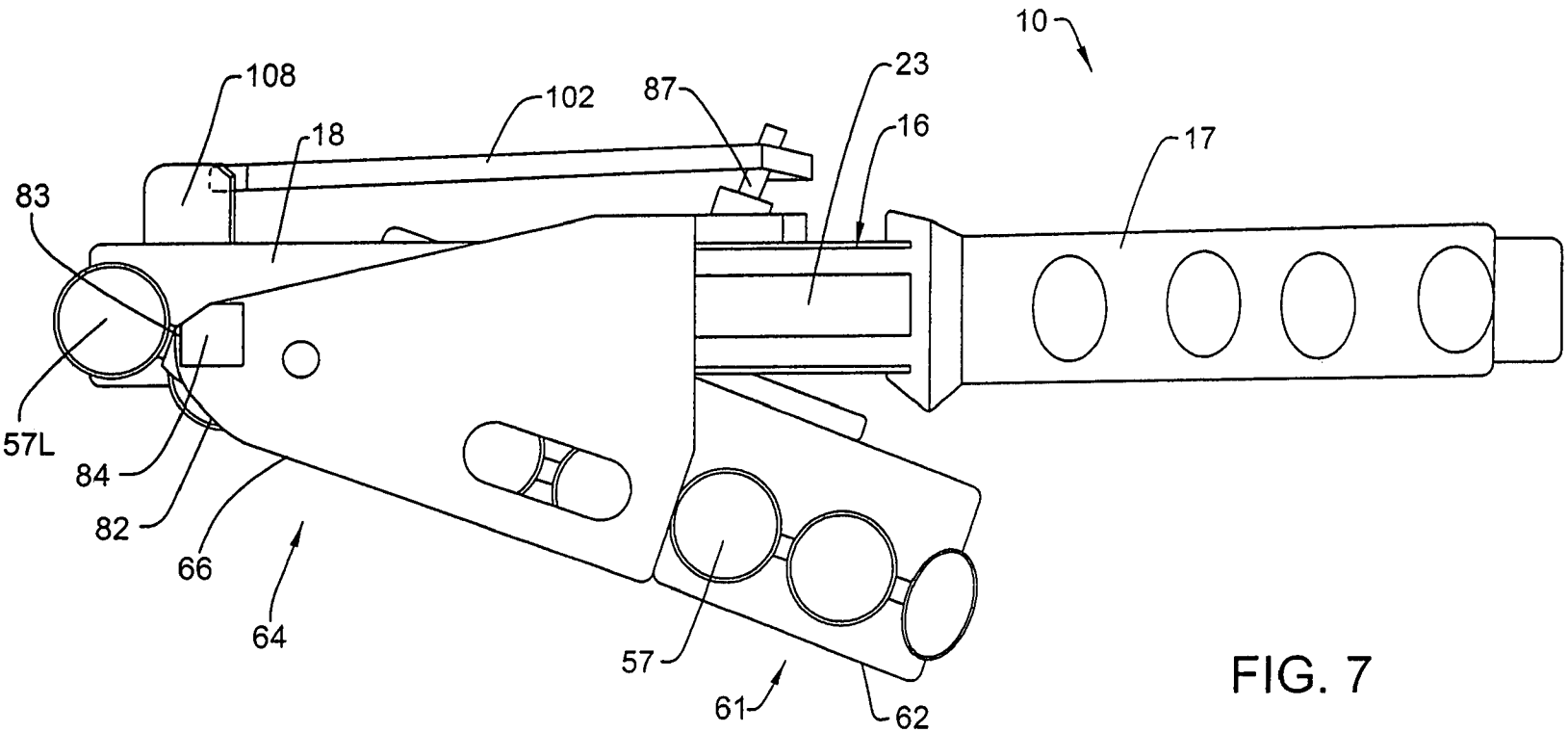
FIG. 7 is a bottom view of the tool illustrated in FIG. 1.

As illustrated by FIG. 5, the front guide track 64 is preferably provided with an anti-backup pawl or member 97 associated therewith to assist in preventing backward movement of the cap strip along the guide passageway 73. Such anti-backup member 97, in the illustrated embodiment, is defined by an elongate cantilevered spring member having one end 98 anchored to the guide member 66 or 68. This anti-backup member 97, at the lead end 99, is provided with a tooth-like protrusion which protrudes downwardly into the triangular clearance space between serially adjacent caps 57 to prevent backward movement of the cap strip along the passage 73. However, when the cap strip is forwardly advanced by the cap feeding pawl 89, the anti-backup member 97 resiliently deflects upwardly to allow the tip end 99 thereof to pass over the advancing cap.

The discharge position 55, as disposed below the staple discharge opening 28, is free of structure or supports, whereby the lead cap 57L as disposed in the discharge position 55 is supported solely by its connection to the adjacent cap of the cap strip.

The cap stapler tool 10, throughout the lengthwise extend of the housing grip part 17, is preferably provided with a suitable grip wrap or covering extending therearound. Such wrap or covering is preferably of a plastic or rubber-like material having at least limited elasticity and cushioning characteristics to provide increased gripping contact with the tool, while also providing at least some shock absorbing capability.

While the operation of the tool 10 of the present invention is believed understood in view of the structural and operational description presented above, it will nevertheless be hereinafter briefly described to ensure a complete understanding thereof.

With the cap magazine 41 in an open position, a cap roll 56 is manually positioned in the interior chamber 42, and the leading end of the coiled cap strip is inserted outwardly through the guide opening 63 and then reversely wrapped around the rear outer guide path member 62. The lead end of the cap strip is then inserted into the rearward end of the cap passageway 73, and the cap strip is advanced along this passageway until the leading cap of the strip is positioned at the discharge position 55, as indicated by the leading cap 57L in FIG. 5. When so positioned, the drive lug 91 on the cap feeding pawl 89 is positioned in the triangular clearance gap between two adjacent caps, such as between the second and third caps, spaced from the free end of the strip (i.e. rearwardly of the cap 57L in FIG. 6).

Prior to insertion of the cap roll 56, the end cover 34 associated with the staple magazine 23 can be opened and the spring rod and pusher removed to permit a fresh staple clip to be inserted, whereupon the pusher and spring rod are re-inserted and the rear cover 34 re-mounted, such being conventional and well known. With the staple magazine 23 and the cap magazine 41 both loaded and closed, and assuming that the lead cap 57L of the cap strip is in the discharge position 55, then the tool 10 is ready to use.

To operate the tool, the operator manually grips the tool 10 in a normal manner by gripping the hand grip 17 and then vertically swings the tool so that the lead or impact end of the tool impacts against a surface of a substrate. This impact between the impact end of the tool and the surface initially causes the tip end 82 of the front guide track 64 to swing upwardly. This effects two functions, one being a temporary clamping of the next cap 57L' between the bottom of the staple magazine and the lower plate-like track member 66, and the other being cutting of the plastic web 58 between the caps 57L and 57L' due to the upward displacement of the cutting blade 83. Substantially simultaneously the striker end 29 of the tool impacts the surface causing, in a conventional manner, the lead staple to be discharged downwardly through the opening 28 along the path 31, whereby the staple penetrates the lead plastic cap 57L disposed in the discharge position 55, with the continued driving discharge of the lead staple causing it to penetrate completely through the cap 57L and hence into the substrate being impacted. The impact of the striker end of the tool against the substrate causes a sudden stoppage of the tool motion, and in fact typically effects some slight rebounding of the tool. The forward swinging inertia of the tool, however, causes the mass 106 to continue to move rapidly forwardly (downwardly in FIG. 4) even though the impact of the tool against the substrate stops further swinging movement of the tool toward the substrate. The continued rapid displacement of the mass 106 downwardly toward the fixed stop 108, acting through the shaft 87 and linkage 85, automatically retracts the cap feeding pawl 89 against the urging of spring 94 through a distance corresponding to the centerline-to-centerline space between adjacent caps, thereby causing the pawl lug 91 to enter into the clearance space behind the second cap spaced from the cutting edge 83. Immediately after the mass 106 contacts the fixed stop 108, thereby automatically dissipating any remaining inertial energy, the spring 94 immediately urges the cap feeding mechanism 14 back toward its original advanced position, namely urging the pawl 89 forwardly so that the lug 91 advances the cap strip forwardly so that the next leading cap 57L' is moved into the discharge position 55. Simultaneously the spring 94, acting through the shaft 87, returns the mass 106 to its raised position so as to be ready to initiate a new cap-advancing cycle. This entire cap advancing cycle hence occurs automatically and rapidly in sequence, and is initiated as a result of a first impact operation being carried out by the tool, with this causing the next cap to be automatically advanced to the discharge position so as to rapidly permit a subsequent staple-cap discharge operation to be performed. Since impact of the tool against the substrate automatically tends to induce at least some rebound motion of the head end of the tool away from the impact zone, this automatically effects movement of the discharge position 55 away from the discharged staple/cap which are now secured to the substrate, and hence permits the next leading cap to be easily and quickly advanced into the discharge position 55 responsive to the previous impact discharge operation.

In the improved tool 10 of this invention, as briefly described above, the disposition of the cap storage and cap advancing linkage adjacent one side of the tool, and the positioning of the inertial energy actuator adjacent the other side of the tool, with all of these constructions positioned in the vicinity of the head part of the tool, is believed to provide a desirable side-to-side balance of the tool, thereby minimizing tipping tendency upon impact of the tool against a substrate surface. Further, these constructions as provided adjacent the head end of the tool also provide desirable weight which is located strategically at the desired part of the tool, namely the head end of the tool, so as to provide optimum impact due to the tool weight, and hence minimize the amount of force which the operator has to apply to the tool during swinging thereof into contact with the substrate. In addition, the storage and guide arrangement for the caps is also positioned so as to be readily viewable by the operator, thereby providing the operator with improved visibility and knowledge with respect to the function and status of the tool.

In the improved tool of this invention, the cap feeding mechanism is activated by inertia energy acting on a freely movable mass, and is not structurally connected to the striker by a movement-constraining link or linkage, whereby improvement performance and durability is believed achieved and the feeding mechanism is isolated from the direct impact forces imposed on the tool.

Applicants' co-pending Ser. No. 11/652,333 is, in its entirety, incorporated herein by reference.

It will be understood that various modifications can be made in the overall tool arrangement of this invention while retaining many of the same desirable tool characteristics. For example, in a first variation, the path-reversing guide 61 can be eliminated, and the cap strip as discharged from the cap magazine 41 can be supplied directly into the feed passageway 73. In a second variation, the cap magazine 41 can be mounted outwardly in aligned relationship at the grip end of the housing, and the cap strip can be fed along a guide arrangement which extends lengthwise along the tool, substantially as illustrated in the aforementioned Ser. No. 11/652,333 application. These variations all permit advancing of the cap strip by an inertia-energy activated feed mechanism similar to the arrangement illustrated and described herein.

While the tool 10 illustrated and described herein is of the type wherein the staple magazine is pivotally supported on the housing and the remote end of the staple magazine functions as the striker for causing staple discharge upon impact, it will be understood that the present invention can also be used in conjunction with a conventional hammer-type stapler of the type wherein the impact end of the housing mounts thereon a separate movable striker which, acting through a typical intermediate link or linkage, effects movement of a staple driving blade which is mounted in close proximity to the striker.

It will be appreciated that the tool of this invention is also suitable for discharging fasteners other than staples, such as for example T-head nails which can be supplied in elongate clips similar to staple clips.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A method of feeding caps from a cap feeding device to a swingable manually-actuated hammer-type stapling tool wherein the tool is elongated and has a grip end for engagement with a user's hand and a head end for ejecting a staple, and wherein the cap feeding device is attached to or forms a part of the manually-actuated stapling tool having a movable striker part that moves with respect to a main housing of the tool, comprising the steps of:

impacting the striker part of the staple tool against a work surface and moving the striker part with respect to the main housing of the tool to eject a staple from the tool;

driving a cap feeder associated with the cap feeding device in response to the manual actuation of the staple tool and the impacting of the head end of the tool against the work surface and the ejection of a staple from the tool;

causing an inertia-induced movement of a mass which is movably mounted on the stapling tool in close proximity to the head end thereof due to the impacting of the head end of the tool against the substrate; and the step of driving the cap feeder including moving a linkage that is interconnected between the mass and the cap feeding device and wherein the movement of the linkage is initiated by the impacting of the head end of the tool against the work surface and causing the inertia-induced movement of the mass, and wherein the movement of the mass is independent of and not controlled by the movement of the striker part relative to the housing.

2. A method of feeding caps from a cap feeding device to a swingable manually-actuated hammer-type stapling tool, wherein the tool is elongated and has a grip end for engagement with a user's hand and a head end for ejecting a staple, the tool having a movable striker part that moves with respect to a main housing of the tool, and wherein the cap feeding device is attached or forms a part of the manually-actuated stapling tool, comprising the steps of:

manually swinging the stapling tool and impacting the striker part thereof against a work surface and causing the striker part to move with respect to the main housing of the tool to eject a staple from the tool along a staple path;

causing inertia-inducted movement of a mass movably mounted on the tool housing due to the impacting of the head end of the tool against the work surface and the stoppage of the swinging movement thereof; and driving a cap feeder associated with the cap feeding device, in response to the inertia-induced movement of the mass caused by impacting of the head end of the tool against the work surface, through a cap feeding cycle to cause a cap to be fed into a position crossing the staple discharge path so as to be positioned for penetration by the next discharged staple;

the inertia-inducted movement of the mass being independent of and not controlled by the movement of the striker part relative to the housing.

3. A method according to claim 2, wherein the step of effecting inertia-induced movement of the mass due to impacting of the head end of the tool against a work surface causes the mass to freely move in a first direction away from a rest position toward a stop position, and thereafter moving the mass rearwardly back towards its rest position by the urging of a spring.

4. A method according to claim 2, providing a cap magazine attached to the tool housing and containing a supply of thin and generally flat caps therein, and discharging caps from said magazine toward the staple discharge path sequentially and one at a time following each discharge of a staple.

5. A method according to claim 2, providing the cap feeding device with a cap feeding member which is movably mounted on the housing, moving the cap feeding member in cap advancing and retracting directions during each cycle of operation including moving said cap feeding member in one of said directions in correspondence to and as a result of the inertia-induced movement of the mass, and moving the cap feeding member in the opposite direction due to urging of a spring after the mass has completed its inertia-induced movement.

6. A method according to claim 5, wherein the cap feeding member is moved in a retracted direction as a result of and corresponding to the inertia-induced movement of the mass, and wherein the cap feeding member is moved in a cap advancing direction for advancing a cap into the staple discharge path due to urging of a spring.

7. A method according to claim 6, including providing the tool with a coupling linkage connected between the mass and the cap feeding member for transmitting the inertia-induced movement of the mass to and causing movement of the cap feeding member.

8. A process for operating a manually-swingable hammer-type impact-activated stapling tool for discharging a staple into a substrate, the stapling tool including a manually-swingable elongated housing having a manual grip structure provided thereon adjacent a rearward end thereof to permit manual gripping and swinging of the tool, a striker part mounted on a head end of the housing and being movable relative to the housing when the striker part impacts against the substrate due to manual swinging of the tool, a staple driving blade mounted on the housing adjacent the head end thereof and movable relative to the striker part along a staple discharge path when the striker part impacts a surface on the substrate, a staple magazine carried on the housing for containing a row of staples which are urged toward the staple discharge path for discharge by the staple driving blade, and a cap supply and feeding arrangement mounted on the housing for positioning a cap in a discharge position disposed below the leading staple and transversely intersecting the staple discharge path, comprising steps of:

providing the cap supply and feeding arrangement with an inertia-activated feeding mechanism for automatically advancing a leading cap from a cap supply into said discharge position responsive to but after said striker impacts against said surface to position the leading cap for penetration by the next discharged staple, including the step of providing an activating mass movably supported on the housing and movable from a first to a second position in response to impact of the striker part against said surface, the movement of said mass being independent of the movement of the striker part relative to the housing, and moving the mass from said first position into said second position solely due to the inertia of the mass caused by the impact of said striker part against said substrate causing such movement as a result of the stoppage of the head end of the tool upon impact with the substrate, and transmitting the mass movement to a cap feeding member to cause corresponding movement thereof for permitting advancing of a cap into the staple discharge path.

* * * * *

UNITED STATES PATENT AND TRADEMARK OFFICE

CERTIFICATE OF CORRECTION

PATENT NO. : 7,836,970 B2
APPLICATION NO. : 12/383775
DATED : November 23, 2010
INVENTOR(S) : Roger C. Bruins et al.

It is certified that error appears in the above-identified patent and that said Letters Patent is hereby corrected as shown below:

Column 15, line 18; change "causing inertia-inducted movement" to --causing inertia-induced movement--

Column 15, line 29; change "the inertia-inducted movement" to --the inertia-induced movement--

Signed and Sealed this
Eighth Day of February, 2011

David J. Kappos

David J. Kappos
*Director of the United States Patent and Trademark Office*